US011859881B2

(12) United States Patent
Deng et al.

(10) Patent No.: US 11,859,881 B2
(45) Date of Patent: Jan. 2, 2024

(54) REFRIGERATION SYSTEM AND CONTROL METHOD THEREFOR

(71) Applicant: Carrier Corporation, Palm Beach Gardens, FL (US)

(72) Inventors: Kai Deng, Shanghai (CN); Vishnu Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 363 days.

(21) Appl. No.: 17/127,018

(22) Filed: Dec. 18, 2020

(65) Prior Publication Data

US 2022/0034560 A1 Feb. 3, 2022

(30) Foreign Application Priority Data

Jul. 31, 2020 (CN) ..... 202010758250.7

(51) Int. Cl.
*F25B 13/00* (2006.01)
*F25B 41/20* (2021.01)
*F25B 49/02* (2006.01)

(52) U.S. Cl.
CPC ..... *F25B 41/20* (2021.01); *F25B 13/00* (2013.01); *F25B 49/02* (2013.01); *F25B 2500/12* (2013.01); *F25B 2500/13* (2013.01)

(58) Field of Classification Search
CPC ..... F25B 41/20; F25B 13/00; F25B 49/02; F25B 2500/12; F25B 2500/13
See application file for complete search history.

(56) References Cited

U.S. PATENT DOCUMENTS 5,575,157 A 11/1996 Harold
6,098,422 A 8/2000 Tischer
(Continued)

FOREIGN PATENT DOCUMENTS

CN 1343295 A 4/2002
CN 1409810 A 4/2003
(Continued)

OTHER PUBLICATIONS

European Search Report for Application No. 20214734.4; dated May 17, 2021; 8 Pages.

*Primary Examiner* — Nael N Babaa
(74) *Attorney, Agent, or Firm* — CANTOR COLBURN LLP

(57) ABSTRACT

Refrigeration systems and control methods therefor are described. The refrigeration systems include a main circuit to connect, through a pipeline, a multi-stage compressor, a condenser, an economizer, a main throttling element, and an evaporator. An air supply branch is configured to connect to the air outlet of the economizer and the intermediate stage air inlet of the multi-stage compressor. A liquid injection branch is configured to connect to the intermediate stage air inlet of the multi-stage compressor from a section having a high-pressure liquid-phase refrigerant in the main circuit. Through the design of the liquid injection branch, the liquid-phase refrigerant can be introduced when vibration or noise of the unit exceeds a limit. The liquid-phase refrigerant, in the form of droplets, can effectively absorb the sound wave energy in the compressor pipeline to reduce an overall discharge pulsation of the compressor and reduce the noise and vibration of the condenser.

16 Claims, 2 Drawing Sheets

(56) References Cited

U.S. PATENT DOCUMENTS

| | | | | |
|---|---|---|---|---|
| 6,272,869 | B1 | 8/2001 | Eber | |
| 8,011,196 | B2 | 9/2011 | Eber et al. | |
| 9,816,733 | B2 | 11/2017 | Haley et al. | |
| 9,890,977 | B2 | 2/2018 | Li et al. | |
| 10,018,393 | B2 | 7/2018 | Kopko et al. | |
| 11,496,621 | B2 * | 11/2022 | Hodge | G06F 16/683 |
| 2014/0341710 | A1 * | 11/2014 | Creamer | F04D 27/001 415/203 |
| 2015/0330692 | A1 * | 11/2015 | Kopko | F25B 49/02 |
| 2021/0010732 | A1 * | 1/2021 | Lindberg | F25B 49/022 62/115 |

FOREIGN PATENT DOCUMENTS

| | | | |
|---|---|---|---|
| CN | 1281909 | C | 10/2006 |
| CN | 1969156 | A | 5/2007 |
| CN | 101018994 | A | 8/2007 |
| CN | 100480600 | C | 4/2009 |
| CN | 100480603 | C | 4/2009 |
| CN | 100526765 | C | 8/2009 |
| CN | 102016326 | A | 4/2011 |
| CN | 101523135 | B | 11/2011 |
| CN | 202281412 | U | 6/2012 |
| CN | 202813921 | U | 3/2013 |
| CN | 202973361 | U | 6/2013 |
| CN | 102037245 | B | 12/2013 |
| CN | 105074360 | A | 11/2015 |
| CN | 107314566 | A | 11/2017 |
| CN | 108061409 | A | 5/2018 |
| CN | 207487161 | U | 6/2018 |
| CN | 109099607 | A | 12/2018 |
| CN | 109114830 | A | 1/2019 |
| CN | 208968100 | U | 6/2019 |
| KR | 20180020633 | A | 6/2018 |
| KR | 20200031812 | A | 3/2020 |
| WO | 2006010391 | A1 | 2/2006 |
| WO | 2010117973 | A2 | 10/2010 |

* cited by examiner

REFRIGERATION SYSTEM AND CONTROL METHOD THEREFOR

CROSS-REFERENCE TO RELATED APPLICATIONS

This application claims priority to Chinese Patent Application No. 202010758250.7, filed Jul. 31, 2020, the contents of which are incorporated by reference herein in their entirety.

BACKGROUND

The present invention relates to the field of refrigeration equipment. More specifically, the present invention relates to a refrigeration system and a control method therefor.

At present, refrigeration systems and related equipment have been widely used in various temperature control fields including household air conditioning, commercial air conditioning, cold chain transportation, and low temperature storage. The technologies for small-scale refrigeration equipment are already very mature. For large-scale refrigeration equipment, however, due to the complexity brought about by various aspects such as high power, high lift, multiple branches, and the like, it usually has higher technical requirements for system setup and control. As a type of application of large-scale refrigeration equipment, a two-stage or three-stage centrifugal compressor has relatively high power and can bear greater refrigerating load limit. However, in the case where it only needs to bear part of the load (which is usually not the working condition of the design point of the centrifugal compressor), due to the small opening of the inlet guide vane of the centrifugal compressor, it will cause severe flow separation in high lift. This kind of flow separation phenomenon will generate a great pressure pulsation and cause a large operating noise and vibration when the refrigerant flows into the condenser, which in turn affects the user experience.

SUMMARY

The present invention provides a refrigeration system and a control method therefor to improve system noise or vibration.

To achieve at least one object of the present application, in accordance with one aspect of the present application, a refrigeration system is provided, comprising: a main circuit configured to connect, through a pipeline, to a multi-stage compressor, a condenser, an economizer, a main throttling element, and an evaporator; an air supply branch configured to connect, through a pipeline, to an air outlet of the economizer and an intermediate stage air inlet of the multi-stage compressor; and a liquid injection branch configured to connect to the intermediate stage air inlet of the multi-stage compressor from a section having a high-pressure liquid-phase refrigerant in the main circuit.

Optionally, the liquid injection branch includes a liquid injection valve for controllably turning on or off the liquid injection branch.

Optionally, the refrigeration system further comprises a vibration sensor and/or a noise sensor provided on the condenser and/or a compressor guide vane opening sensor arranged in the multi-stage compressor, wherein, the liquid injection valve turns on the liquid injection branch when the detection result of the vibration sensor exceeds a preset vibration value and/or the detection result of the noise sensor exceeds a preset noise value and/or the compressor guide vane opening is less than a preset guide vane opening value.

Optionally, the liquid injection valve is controllably turned on or off to control the superheat of the main circuit to be not less than a preset superheat value.

Optionally, the liquid injection branch is connected to the intermediate stage air inlet of the multi-stage compressor from the section between the outlet of the condenser and the economizer.

Optionally, the liquid injection branch is connected from the section having the high-pressure liquid-phase refrigerant in the main circuit to the intermediate stage air inlet via the section between the air supply valve on the air supply branch and the intermediate stage air inlet.

Optionally, the multi-stage compressor is a two-stage or three-stage centrifugal compressor.

Optionally, the liquid injection valve is an electric valve and/or a throttle orifice.

Optionally, the liquid injection branch is configured such that the liquid-phase refrigerant enters the intermediate stage air inlet of the multi-stage compressor in the form of droplets.

To achieve at least one object of the present application, in accordance with another aspect of the present application, a control method for a refrigeration system is further provided, which is used in the aforementioned refrigeration system, wherein the method comprises: when the vibration of the condenser exceeds the preset vibration value and/or the noise exceeds the preset noise value or the compressor guide vane opening is less than the preset guide vane opening value, the liquid injection branch is turned on and liquid-phase refrigerant is introduced to absorb the vibration; and when the superheat of the system is less than the preset superheat value, the liquid injection branch is turned off.

According to the refrigeration system and the control method therefor of the present application, by providing a liquid injection branch between the section having a high-pressure liquid-phase refrigerant in the main circuit and the air supply branch, the liquid phase refrigerant can be introduced when the vibration or noise of the compressor exceeds the limit. The liquid-phase refrigerant in the form of droplets can effectively absorb the sound wave energy in the compressor pipeline, thereby reducing the overall discharge pulsation of the compressor and eventually reducing the noise and vibration of the condenser.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
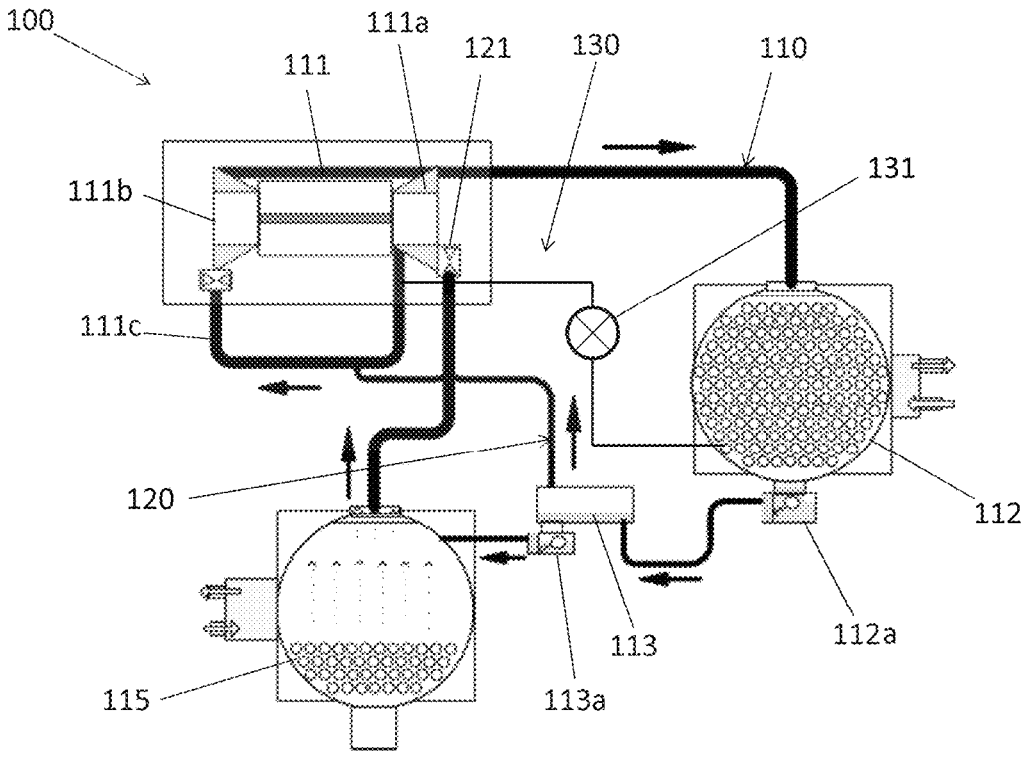
FIG. 1 is a system schematic diagram of an embodiment of the refrigeration system of the present application.

The present application will be described in detail below with reference to the exemplary embodiments in the drawings. However, it should be understood that the present application can be implemented in many different forms and should not be construed as being limited to the embodiments set forth herein. The purpose of providing these embodiments here is to make the disclosure of the present application completer and more comprehensive, and to completely convey the concept of the present application to those skilled in the art.

Referring to FIG. 1, it shows an embodiment of a refrigeration system according to the present application. From the perspective of pipeline connection, the refrigeration system 100 includes a main circuit 110, an air supply branch 120, and a liquid injection branch 130. The main circuit 110 includes a multi-stage compressor 111, a condenser 112, an economizer 113, a main throttling element, and an evaporator 115 connected in series through a pipeline. The air supply branch 120 is connected to the air outlet of the economizer 113 and the intermediate stage air inlet of the multi-stage compressor 111 through a pipeline. Under such a configuration, when the refrigeration system is operating normally, the gas-phase refrigerant compressed by the compressor enters the condenser 112 to be condensed into a low-temperature and high-pressure liquid-phase refrigerant, and then enters the economizer 113, where a part of the liquid-phase refrigerant evaporates to allow another part of the liquid-phase refrigerant to be further cooled. The cooled liquid-phase refrigerant undergoes throttling expansion through an economizer float valve 113*a* used as the main throttling element to form a low-temperature and low-pressure liquid-phase refrigerant, enters the evaporator 115 to absorb heat and evaporate, and then returns to the multi-stage compressor 111 via the air inlet of the multi-stage compressor 111 to start a new cycle. Another part of the gas-phase refrigerant formed by absorbing heat and evaporating in the economizer 113 directly enters the intermediate stage air inlet of the multi-stage compressor 111 via the air supply branch 120 for vapor supply and enthalpy rise, so as to improve system efficiency.

On this basis, the refrigeration system further includes a liquid injection branch 130 that is connected to the intermediate stage air inlet of the multi-stage compressor 111 from a section having a high-pressure liquid-phase refrigerant in the main circuit 110. Under such a configuration, when the vibration or noise of the compressor exceeds the limit or the guide vane opening is less than the preset value, the liquid-phase refrigerant can be introduced via the liquid injection branch. The liquid-phase refrigerant in the form of droplets can effectively absorb the sound wave energy in the compressor pipeline, thereby reducing the overall discharge pulsation of the compressor and eventually reducing the noise and vibration at the unit.

The structure of each part of the refrigeration system will be introduced as follows. In addition, in order to further improve the system's energy efficiency, reliability or other aspects, some additional components can also be added, as shown in the following example.

For example, considering that the liquid injection branch 130 is mainly used for absorbing sound wave energy through refrigerant droplets to achieve the purpose of reducing noise, it is not a flow path that needs to participate in the work at all times during system operation. Therefore, it can be controllably turned on and off. For example, a liquid injection valve 131 for controllably turning on or off the liquid injection branch 130 is provided thereon, and the liquid injection valve 131 may be specifically in the form of an actively controlled electric valve and/or a passively controlled throttle orifice.

More specifically, it can also be provided with additional sensors to obtain its relatively clear judgement timing for turn-on and turn-off. For example, a vibration sensor or a noise sensor is additionally provided on the condenser 112, where the liquid injection valve 131 can turn on the liquid injection branch 130 when the detection result of the vibration sensor exceeds the preset vibration value, or turn on the liquid injection branch 130 when the detection result of the noise sensor exceeds the preset noise value; or, a compressor guide vane opening sensor is provided in the multi-stage compressor, where the liquid injection valve 131 can turn on the liquid injection branch 130 when the compressor guide vane opening is less than the preset value. As a result, it only works when the system noise exceeds the limit, which can effectively and pertinently improve the user experience. When there is no such problem of noise overrun, however, the system can still focus on improving the energy efficiency of the system.

In addition, the turn-on and turn-off of the liquid injection valve 131 can also be controlled according to the superheat of the evaporator of the main circuit 110, so as to avoid the bypass of excessive liquid-phase refrigerant which will lead to the problem that the amount of liquid-phase refrigerant participating in the evaporation and heat exchange in the main circuit is too low, thereby ensuring the superheat of the evaporator outlet.

For another example, also considering that the liquid injection branch 130 is mainly used to absorb sound wave energy through refrigerant droplets to achieve the purpose of reducing noise, the location where the liquid injection branch 130 is connected to the main circuit 110 may be further designed. For example, the liquid inlet of the liquid injection branch 130 can be provided in the section from the outlet of the condenser 112 to the economizer 113, thereby ensuring the purity of the liquid introduced into the liquid injection branch 130. Specifically, referring to FIG. 1, the condenser 112 used in the figure is a shell and tube heat exchanger, and a condenser float valve 112*a* with throttling function is provided at the bottom of the heat exchanger. The high-temperature and high-pressure gas enters the condenser 112 from the compressor 111, exchanges heat with the coolant (such as cooling water) that enters the condenser through the tube bundle, and then condenses into liquid-phase refrigerant, which is accumulated at the bottom of the shell and tube heat exchanger After reaching a certain pressure, the liquid-phase refrigerant drives the condenser float valve 112*a* to open the flow path, and then flows into the economizer 113 for flash evaporation. Therefore, the bottom outlet of this type of condenser 112 is almost filled with low-temperature and high-pressure liquid-phase refrigerant, and it remains in a liquid-phase state in the pipeline section before it enters the economizer and is further flash evaporated and separated into liquid-phase refrigerant and gas-phase refrigerant. Therefore, all the refrigerant in this section meets the requirement of being introduced to the intermediate stage suction port of the compressor to absorb vibration, so the liquid inlet of the liquid injection branch 130 can be arranged here.

Still for another example, the liquid outlet of the liquid injection branch 130 can be provided in the section between the air supply valve 121 on the air supply branch 120 and the intermediate stage air inlet, thereby ensuring that this part of the liquid-phase refrigerant is reliably and stably sucked into the intermediate stage of the compressor to perform its noise reduction function. Specifically, referring to FIG. 1, since the centrifugal compressor used here is a back to back two stage compressor, it has an inter-stage flow path 111*c* disposed outside the compressor housing to introduce the refrigerant gas between the first stage 111*a* and the second stage 111*b* of the compressor. This type of compressor with an external inter-stage flow path 111*c* can introduce the liquid-phase refrigerant into the compressor to absorb sound wave energy and reduce vibration in a more convenient manner. For example, at this time, the air supply branch 120 can be connected from any point on the inter-stage flow path 111*c* for vapor supply and enthalpy rise. Whereas, the liquid injection branch 130 can be connected to the pipeline section from the downstream of the air supply valve (not shown in FIG. 1) of the air supply branch 120, thereby being indirectly connected to the inter-stage flow path 111*c*, or can be directly connected to the inter-stage flow path 111*c*, or can be directly connected to the first-stage compressor volute (for a back to back two stage compressor), and finally enters the two-stage or three-stage compressor through the intermediate stage air inlet of the compressor to achieve its purpose of absorbing vibration.

In addition, still referring to FIG. 1, considering that the inlet guide vane of the centrifugal compressor is likely to cause high-lift flow separation at small opening, when the multi-stage compressor 111 used in the foregoing system is a two-stage centrifugal compressor, it has a better noise improvement effect.

Furthermore, considering that the droplets have a better effect of absorbing sound wave energy than the liquid flow, the pipeline of the liquid injection branch 130 can be adjusted and arranged, for example, the diameter of the pipe can be changed, such that the liquid-phase refrigerant enters between the air outlet of the economizer 113 and the intermediate stage air inlet of the multi-stage compressor 111 in the form of droplets.

Figure 2:
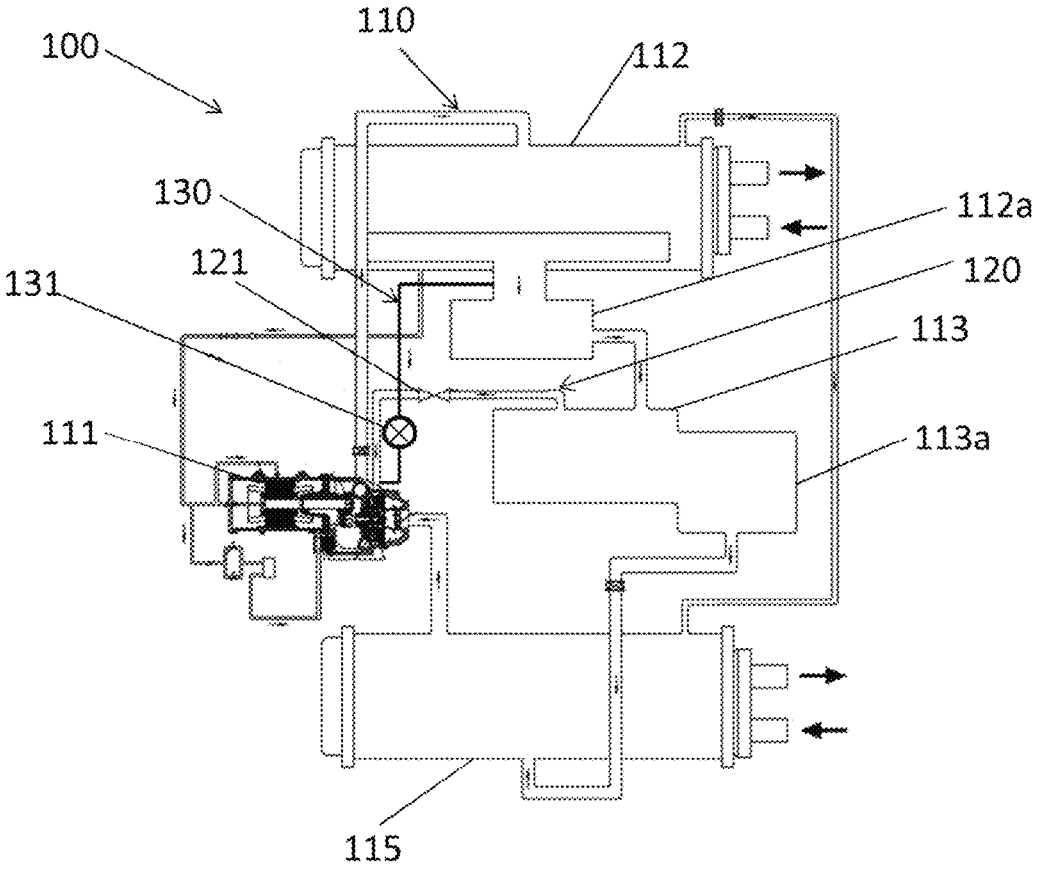
FIG. 2 is a system schematic diagram of another embodiment of the refrigeration system of the present application.

Now turning to FIG. 2, another embodiment of the refrigeration system 100 is shown here, which has a system flow path configuration similar to that of the embodiment shown in FIG. 1. Accordingly, unless it is obviously to the contrary, in general, the various improvements mentioned in the embodiment in FIG. 1 can also be applied to this embodiment, so it will not be further discussed here. The following will focus on the special features of the embodiment shown in FIG. 2.

In comparison, the refrigeration system 100 shown in FIG. 2 uses another type of compressor 111, that is, a two-stage compressor with a built-in inter-stage flow path, with the flow path introducing the refrigerant gas between the first stage and the second stage of the compressor arranged within the housing of the compressor 111. For this type of compressor, on the one hand, the liquid injection branch 130 can be connected to the intermediate stage air inlet of the compressor from the downstream of the air supply valve 121 of the air supply branch 120, so as to share part of the flow path with the air supply branch 120 to achieve its purpose of absorbing vibration, with no need to make other modifications to the compressor; on the other hand, an additional port can be open on the compressor to connect the liquid injection branch 130 to the intermediate stage air inlet of the compressor independent of the air supply branch 120 to achieve its purpose of absorbing vibration and avoid the mutual influence between the two branches.

Similarly, although not shown in the drawings, a control method for the refrigeration system 100 is additionally provided, which can be applied to the refrigeration system 100 according to the foregoing embodiments or any combination thereof, thereby providing a better noise reduction effect for the system. Specifically, the method comprises: when the vibration of the condenser 112 exceeds the preset vibration value and/or the noise exceeds the preset noise value and/or the guide vane opening is less than the preset value, the liquid injection branch 130 is turned on and liquid-phase refrigerant is introduced to absorb the vibration. As a result, it only works when the system noise exceeds the limit, which can effectively and pertinently improve the user experience. When there is no such problem of noise overrun, however, the system can still focus on improving the energy efficiency of the system. When the superheat of the system is less than the preset superheat value, the liquid injection branch 130 is turned off, so as to avoid the bypass of excessive liquid-phase refrigerant which will lead to the problem that the amount of liquid-phase refrigerant participating in the evaporation and heat exchange in the main circuit is too low, thereby ensuring the superheat of the evaporator outlet.

The flow path of the refrigerant in the normal operating mode and the vibration-reduction operating mode will be described respectively in conjunction with the embodiment of the refrigeration system shown in FIG. 1 as follows. FIG. 2 is only different from FIG. 1 in the selection of compressor, so the operating process described below is also applicable to the embodiment shown in FIG. 2.

In the normal operating mode, the gas-phase refrigerant compressed by the compressor 111 enters the condenser 112 to be condensed into a low-temperature and high-pressure liquid-phase refrigerant, and then enters the economizer 113. At this time, since the air supply branch 120 is turned off by the air supply valve, the refrigerant flows directly through the economizer 113, undergoes throttling expansion at the economizer float valve 113*a*, and enters the evaporator 115 to absorb heat and evaporate into a gas-phase refrigerant. The gas-phase refrigerant then flows into the first stage 111*a* of the compressor 111 and flows out of the compressor after two stages of compression to start a new cycle.

When the air supply mode is turned on, the air supply branch 120 is turned on by the air supply valve. At this time, a part of the liquid-phase refrigerant evaporates in the economizer to allow another part of the liquid-phase refrigerant to be further cooled. The cooled liquid-phase refrigerant undergoes throttling expansion through an economizer float valve 113*a* to form a low-temperature and low-pressure liquid-phase refrigerant, enters the evaporator 115 to absorb heat and evaporate, returns to the multi-stage compressor 111 via the air inlet of the multi-stage compressor 111, and flows out of the compressor 111 after two stages of compression to start a new cycle. Another part of the gas-phase refrigerant formed by absorbing heat and evaporating in the economizer 113 directly enters the intermediate stage air inlet of the compressor 111 via the air supply branch 120 for vapor supply and enthalpy rise, so as to improve system efficiency.

In addition, when the refrigeration system causes excessive vibration of the condenser due to reasons such as high lift and low load, the liquid injection branch can be turned on. At this time, the high-pressure liquid-phase refrigerant is introduced into the inter-stage flow path of the compressor via the bottom of the condenser 112 and forms tiny droplets to absorb sound wave energy on the inter-stage flow path, thereby achieving the purpose of reducing vibration.

The above examples mainly illustrate the refrigeration system and the control method therefor of the present invention. Although only some of the embodiments of the present invention are described, those skilled in the art understand that the present invention can, without departing from the spirit and scope of the invention, be implemented in many other forms. Therefore, the illustrated examples and embodiments are to be considered as illustrative but not restrictive, and the present invention may cover various modifications or replacements if not departed from the spirit and scope of the present invention as defined by the appended claims.

What is claimed is:

1. A refrigeration system, comprising:

a main circuit configured to connect, through a pipeline, to a multi-stage compressor, a condenser, an economizer, a main throttling element, and an evaporator;

an gas supply branch configured to connect, through a pipeline, to the gas outlet of the economizer and an intermediate stage gas inlet of the multi-stage compressor; and a liquid injection branch configured to connect to the intermediate stage gas inlet of the multi-stage compressor from a section having a high-pressure liquid-phase refrigerant in the main circuit;

wherein the liquid injection branch includes a liquid injection valve for controllably turning on or off the liquid injection branch;

further comprising a vibration sensor and/or a noise sensor provided on the condenser and/or a compressor guide vane opening sensor arranged in the multi-stage compressor; wherein, the liquid injection valve turns on the liquid injection branch when the detection result of the vibration sensor exceeds a preset vibration value and/or the detection result of the noise sensor exceeds a preset noise value and/or the compressor guide vane opening is less than a preset guide vane opening value.

2. The refrigeration system according to claim 1, wherein the liquid injection valve is controllably turned on or off to control the superheat of the main circuit to be not less than a preset superheat value.

3. The refrigeration system according to claim 1, wherein the liquid injection branch is connected to the intermediate stage gas inlet of the multi-stage compressor from the section between an outlet of the condenser and the economizer.

4. The refrigeration system according to claim 1, wherein the liquid injection branch is connected from a section having high-pressure liquid-phase refrigerant in the main circuit to the intermediate stage gas inlet via a section between the gas supply valve on a gas supply branch and the intermediate stage gas inlet.

5. The refrigeration system according to claim 1, wherein the multi-stage compressor is a two-stage or three-stage centrifugal compressor.

6. The refrigeration system according to claim 1, wherein the liquid injection valve is an electric valve and/or a throttle orifice.

7. The refrigeration system according to claim 1, wherein the liquid injection branch is configured such that the liquid-phase refrigerant enters the intermediate stage gas inlet of the multi-stage compressor in the form of droplets.

8. A control method for a refrigeration system having a main circuit configured to connect, through a pipeline, to a multi-stage compressor, a condenser, an economizer, a main throttling element, and an evaporator, an gas supply branch configured to connect, through a pipeline, to the gas outlet of the economizer and an intermediate stage gas inlet of the multi-stage compressor and a liquid injection branch configured to connect to the intermediate stage gas inlet of the multi-stage compressor from a section having a high-pressure liquid-phase refrigerant in the main circuit, the method comprising:

when the vibration of the condenser exceeds a preset vibration value and/or the noise exceeds a preset noise value or the compressor guide vane opening is less than a preset guide vane opening value, the liquid injection branch is turned on and liquid-phase refrigerant is introduced to absorb the vibration; and when the superheat of the system is less than the preset superheat value, the liquid injection branch is turned off.

9. The method of claim 8, wherein the liquid injection branch includes a liquid injection valve for controllably turning on or off the liquid injection branch.

10. The method of claim 9, further comprising a vibration sensor and/or a noise sensor provided on the condenser and/or a compressor guide vane opening sensor arranged in the multi-stage compressor; wherein, the liquid injection valve turns on the liquid injection branch when the detection result of the vibration sensor exceeds the preset vibration value and/or the detection result of the noise sensor exceeds the preset noise value and/or the compressor guide vane opening is less than the preset guide vane opening value.

11. The method of claim 9, wherein the liquid injection valve is controllably turned on or off to control the superheat of the main circuit to be not less than a preset superheat value.

12. The method of claim 8, wherein the liquid injection branch is connected to the intermediate stage gas inlet of the multi-stage compressor from the section between an outlet of the condenser and the economizer.

13. The method of claim 8, wherein the liquid injection branch is connected from the section having the high-pressure liquid-phase refrigerant in the main circuit to the intermediate stage gas inlet via the section between a gas supply valve on the gas supply branch and the intermediate stage gas inlet.

14. The method of claim 8, wherein the multi-stage compressor is a two-stage or three-stage centrifugal compressor.

15. The method of claim 8, wherein the liquid injection valve is an electric valve and/or a throttle orifice.

16. The method of claim 8, wherein the liquid injection branch is configured such that the liquid-phase refrigerant enters the intermediate stage gas inlet of the multi-stage compressor in the form of droplets.

* * * * *